United States Patent [19]

Scott

[11] 4,057,968

[45] Nov. 15, 1977

[54] IRRIGATION GRAVEL GUARD

[76] Inventor: Robert A. Scott, 1910 Spring Road, Grand Island, Nebr. 68801

[21] Appl. No.: 505,610

[22] Filed: Sept. 12, 1974

[51] Int. Cl.[2] ..... E02B 13/00

[52] U.S. Cl. ..... 61/12; 61/13; 210/445

[58] Field of Search ..... 61/11, 12, 13; 210/445, 210/446

[56] References Cited

U.S. PATENT DOCUMENTS

| | | | |
|---|---|---|---|
| 565,890 | 8/1896 | Fowler | 210/445 X |
| 680,096 | 8/1901 | West | 210/445 X |
| 1,165,137 | 12/1915 | Smith | 61/11 |
| 1,704,634 | 3/1929 | Snider | 210/445 |
| 1,768,310 | 6/1930 | Erickson | 61/12 |
| 2,370,668 | 3/1945 | Johnson | 210/445 X |
| 2,384,057 | 9/1945 | Wetherell | 210/445 X |
| 2,515,600 | 7/1950 | Hayes | 61/12 X |
| 2,530,283 | 11/1950 | Brown | 210/445 X |
| 2,835,391 | 5/1958 | Bottum | 210/445 X |
| 3,794,180 | 2/1974 | Blocker | 210/445 |

*Primary Examiner*—Dennis L. Taylor
*Attorney, Agent, or Firm*—Zarley, McKee, Thomte, Voorhees & Sease

[57] ABSTRACT

An irrigation gravel guard is disclosed comprising a ring shaped support having a substantially conical shaped screen means secured thereto and extending therefrom. One end of the screen means is open and is secured to the ring shaped support by welding or the like. The other end of the screen means is rolled or crimped upon itself to substantially close the other end thereof except for the perforations extending therethrough. An extension screen for use with the gravel guard is also disclosed and comprises a pair of spaced apart ring shaped supports having a truncated conical shaped screen means secured thereto and extending therebetween. The extension may be welded to the end of the gravel guard so as to effectively increase the over-all length thereof.

2 Claims, 7 Drawing Figures

IRRIGATION GRAVEL GUARD

BACKGROUND OF THE INVENTION

This invention relates to a gravel guard and more particularly to a gravel guard for use in irrigation pipes and couplers which prevents gravel or the like from flowing through the pipe so as to prevent clogging of the sprinkler heads.

Various types of gravel guards have been provided but the cost of manufacturing the same has greatly decreased the desirability thereof. Additionally, certain types of the existing gravel guards seriously restrict the flow of water through the pipe. Additionally, conventional gravel guards do not have any means for effectively extending the over-all length thereof.

Therefore, it is a principal object of the invention to provide an improved gravel guard for use with irrigation pipes and couplers.

A further object of the invention is to provide a gravel guard having a ring shaped support at one end thereof which engages the inner end portion of the male coupler to limit the inward movement of the gravel guard with respect to the irrigation pipe.

A further object of the invention is to provide a gravel guard which does not undesirably restrict the flow of water therethrough.

A further object of the invention is to provide a gravel guard which may be produced economically.

A further object of the invention is to provide a gravel guard which is durable in use.

A still further object of the invention is to provide an extension for a gravel guard.

These and other objects will be apparent to those skilled in the art.

BRIEF DESCRIPTION OF THE DRAWINGS

This invention consists in the construction arrangements and combination of the various parts of the device, whereby the objects contemplated are attained as hereinafter more fully set forth, specifically pointed out in the claims, and illustrated in the accompanying drawings, in which:

DESCRIPTION OF THE PREFERRED EMBODIMENTS

Figure 1:
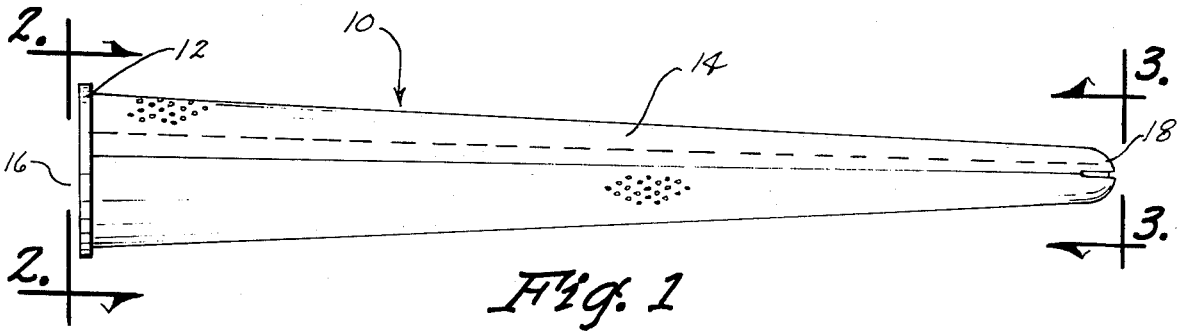
FIG. 1 is a side view of the gravel guard of this invention.
Figure 2:
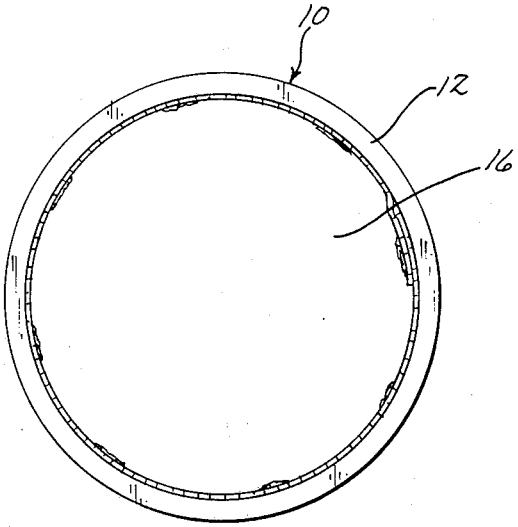
FIG. 2 is an end view of the gravel guard as seen on lines 2 — 2 of FIG. 1.
Figure 3:
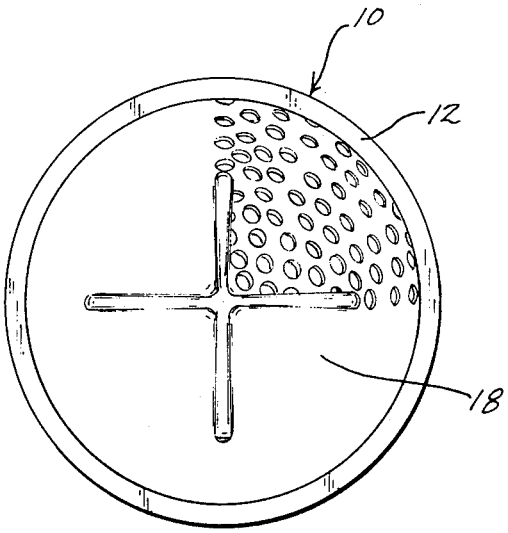
FIG. 3 is an end view of the gravel guard as seen on lines 3 — 3 of FIG. 1.

In FIG. 1, the numeral 10 refers generally to the gravel guard of this invention. Guard 10 comprises a ring shaped support 12 and a substantially conical shaped perforated screen 14 secured thereto. Screen 14 includes an open end portion 16 which is received by the support 12 and which is welded thereto by any convenient means. As seen in the drawings, screen 14 is tapered so that end 18 has a smaller diameter than end 16. End 18 is crimped upon itself as illustrated in FIG. 3 so as to substantially close end 18 except for the perforations of the screen extending therethrough.

Preferably, screen 14 is comprised of twenty gauge galvanized iron having 1/8 inch, 3/32 inch or 1/16 inch in diameter. The difference in hole size of the screens is required because of the different size sprinkler heads ordinarily used in conjunction with the irrigation pipe. Support 12 is preferably constructed of a steel material having a wall thickness of approximately one/fourth inch.

Figure 4:
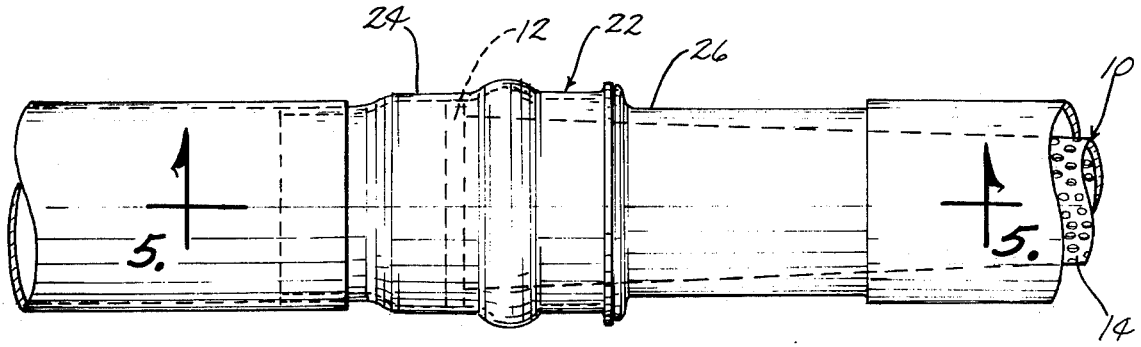
FIG. 4 is a partial elevational view of an irrigation coupling unit with the gravel guard of this invention mounted therein.
Figure 5:
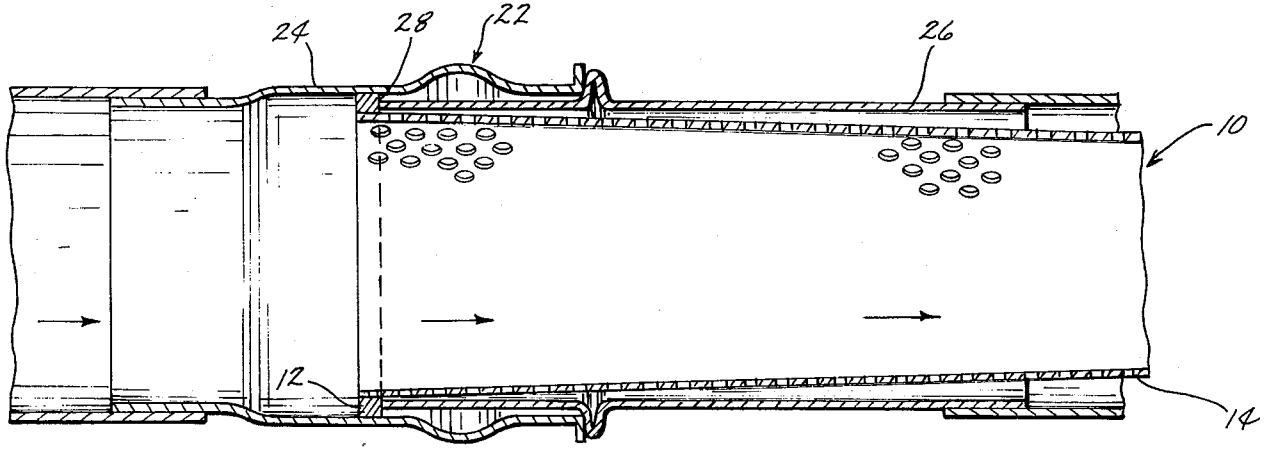
FIG. 5 is a sectional view as seen on lines 5 — 5 of FIG. 4

FIGS. 4 and 5 illustrate the gravel guard 10 as used with a conventional irrigation coupler 22 comprised of a female coupler 24 and a male coupler 26. Coupler 26 includes an inner end portion 28 as illustrated in FIG. 5. The gravel guard 10 is mounted in the irrigation pipe by simply disconnecting the coupler 24 and 26 and inserting the guard 10 into the open end of the male coupler 26 as illustrated in FIG. 5. The inward movement of guard 10 with respect to the irrigation pipe and the coupler 26 is limited by the engagement of the ring shaped support 12 as depicted in FIG. 5. The direction of flow of water is indicated with arrows in FIG. 5 and it can be seen that the guard 10 would move with the flow of water if support 12 did not engage the inner end 28 of the male coupler 26.

The shape of the gravel guard and the perforations thereof are such that the flow of water therethrough is not undesirably affected but the gravel in the water will be trapped in the interior of the guard to prevent the gravel from becoming clogged in the sprinkler heads along the length of the irrigation pipe. The configuration of the end 18 of the screen 14 is important since it does not undesirably affect the flow of water therethrough but it does trap the gravel therein.

In FIG. 4, the numeral 30 refers generally to an extension which may be used in combination with the guard 10 if desired. Extension 30 comprises a pair of spaced apart ring shaped supports 32 and 34 having a truncated conical shaped screen means 36 secured thereto and extending therebetween. Support 34 has the same diameter as the support 12 with support 32 having a larger diameter than either of the supports 12 or 34. Screen means 36 is constructed of the same material as the screen means 14.

Figure 6:
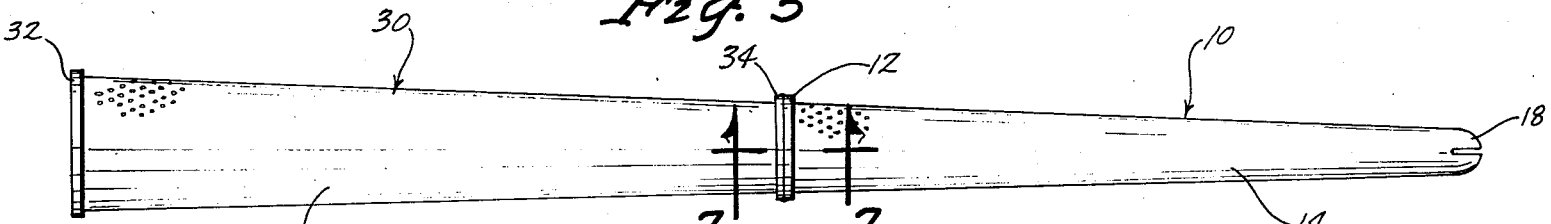
FIG. 6 is a side view of a gravel guard extension for use with the gravel guard of this invention.
Figure 7:
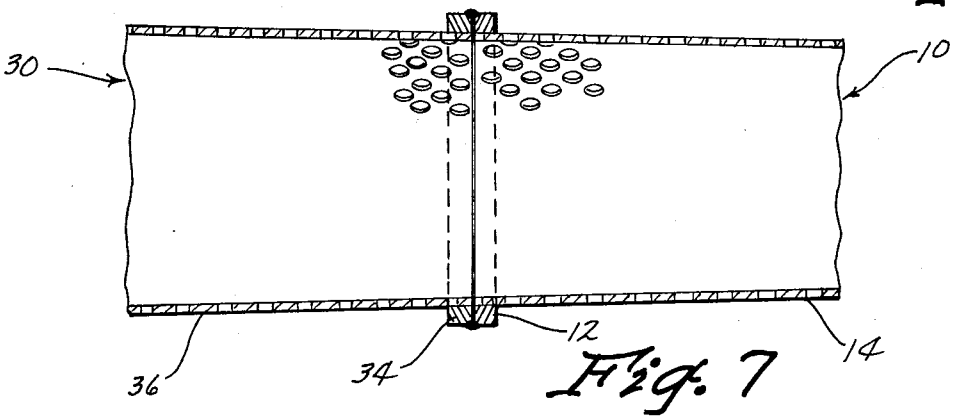
FIG. 7 is a sectional view as seen on lines 7 — 7 of FIG. 6.

Extension 30 is extremely convenient when it is desired to effectively increase the length of the gravel guard since the extension 30 also acts as a gravel guard. The extension 30 may be shipped separately from the guard 10 so as to decrease the over-all length of the structure. When it is desired to employ both the guard 10 and the extension 30, the elements are positioned as seen in FIG. 6 with the supports 12 and 34 being welded together to rigidly secure the same. The extension 30 and the guard 10 are then inserted into the interior of the male coupler so that the support 32 engages the inner end thereof to limit the inward movement of the extension and the guard with respect to the irrigation pipe. It should be noted that a smaller than ordinary diameter guard 10 is used in conjunction with an extension 30 to permit the guard 10 to extend through the male coupler.

Thus it can be seen that a novel extension and gravel guard have been provided which prevents gravel from becoming clogged in the sprinkler heads in an irrigation pipe without seriously effecting the flow of water through the pipe. It can therefore be seen that the invention accomplishes at least all of its stated objectives.

I claim:

1. In combination, an irrigation pipe, a gravel screen positioned in said pipe, said gravel screen comprising a first ring shaped support, a first hollow, truncated conical shaped screen means having first and second ends and being secured at its said first end to said first support, a second ring shaped support secured to said second end of said first screen means, a third ring shaped support secured to said second support and having substantially the same diameter thereas, a second hollow substantially conical shaped screen means secured to said third support and extending therefrom, said second screen means having first and second ends, said first end of said second screen means being open and being secured to said third support, said second end of said second screen means having a diameter less than said first end thereof, said second end of said second screen means being substantially closed except for perforations extending therethrough.

2. The combination of claim 1 wherein said second end of said second screen means is crimped upon itself to form an arcuate end portion.

* * * * *